United States Patent [19]

Prengaman

[11] 3,953,244

[45] Apr. 27, 1976

[54] METHOD OF FABRICATING STABLE WROUGHT LEAD-CALCIUM-TIN ALLOYS BY MEANS OF COLD WORKING

[75] Inventor: Raymond D. Prengaman, Arlington, Tex.

[73] Assignee: St. Joe Minerals Corporation, New York, N.Y.

[22] Filed: May 30, 1975

[21] Appl. No.: 582,119

Related U.S. Application Data

[60] Continuation-in-part of Ser. No. 472,113, May 22, 1974, abandoned, which is a continuation-in-part of Ser. Nos. 394,096, Sept. 4, 1973, abandoned, and Ser. No. 369,452, June 13, 1973, abandoned, said Ser. No. 394,096, is a continuation of Ser. No. 328,333, Jan. 31, 1973, abandoned, said Ser. No. 369,452, is a division of Ser. No. 328,333, , which is a continuation-in-part of Ser. No. 72,825, Sept. 16, 1970, abandoned, which is a continuation-in-part of Ser. No. 4,240, Jan. 20, 1970, abandoned.

[52] U.S. Cl. ..... 148/2; 29/527.5; 29/527.7; 72/700; 75/167; 148/11.5 R; 148/12.7; 148/3 Z; 164/76

[51] Int. Cl.[2] ..... B23K 19/00

[58] Field of Search ..... 148/2, 32, 11.5 R, 12.7; 29/527.5, 527.7; 75/167; 164/76; 72/700

[56] References Cited

UNITED STATES PATENTS

| | | | |
|---|---|---|---|
| 2,049,938 | 8/1936 | Anderson et al. | 75/167 X |
| 2,142,835 | 1/1939 | Betterton et al. | 75/167 |
| 2,159,124 | 5/1939 | Betterton et al. | 75/167 |
| 3,706,605 | 12/1972 | Newbury et al. | 148/11.5 R |

FOREIGN PATENTS OR APPLICATIONS

| | | | |
|---|---|---|---|
| 314,522 | 9/1930 | United Kingdom | 75/167 |
| 548,775 | 10/1942 | United Kingdom | 75/167 |

OTHER PUBLICATIONS

Greenwood, et al., "The Influence of Calcium on the Creep Characteristics of Lead", Metallurgic Vol. 39, No. 233, 3/49 pp. 241–245.

*Primary Examiner*—Arthur J. Steiner
*Attorney, Agent, or Firm*—Brumbaugh, Graves, Donohue & Raymond

[57] ABSTRACT

Stable wrought lead-calcium-tin alloys can be prepared by casting an alloy of lead having a calcium content of from about 0.02% or 0.03% to about 0.1% by weight and having a tin content such that the tin to calcium weight ratio or relative tin content is from about 7:1 to 10:1 and preferably is more than 10:1 up to about 100:1, with the proviso that the absolute tin content be from about 0.3% to about 2.0%; and thereafter cold working the casting at a time period of within about 24 hours after casting for the lead-calcium-tin alloys having a tin to calcium weight ratio of from about 7:1 to 10:1 and within about 48 hours after casting for the lead-calcium-tin alloys having a tin to calcium weight ratio of from more than 10:1 up to about 100:1.

Aged work pieces heated sufficiently to dissolve the precipitated calcium phases can be similarly treated.

35 Claims, 9 Drawing Figures

Figure 1:
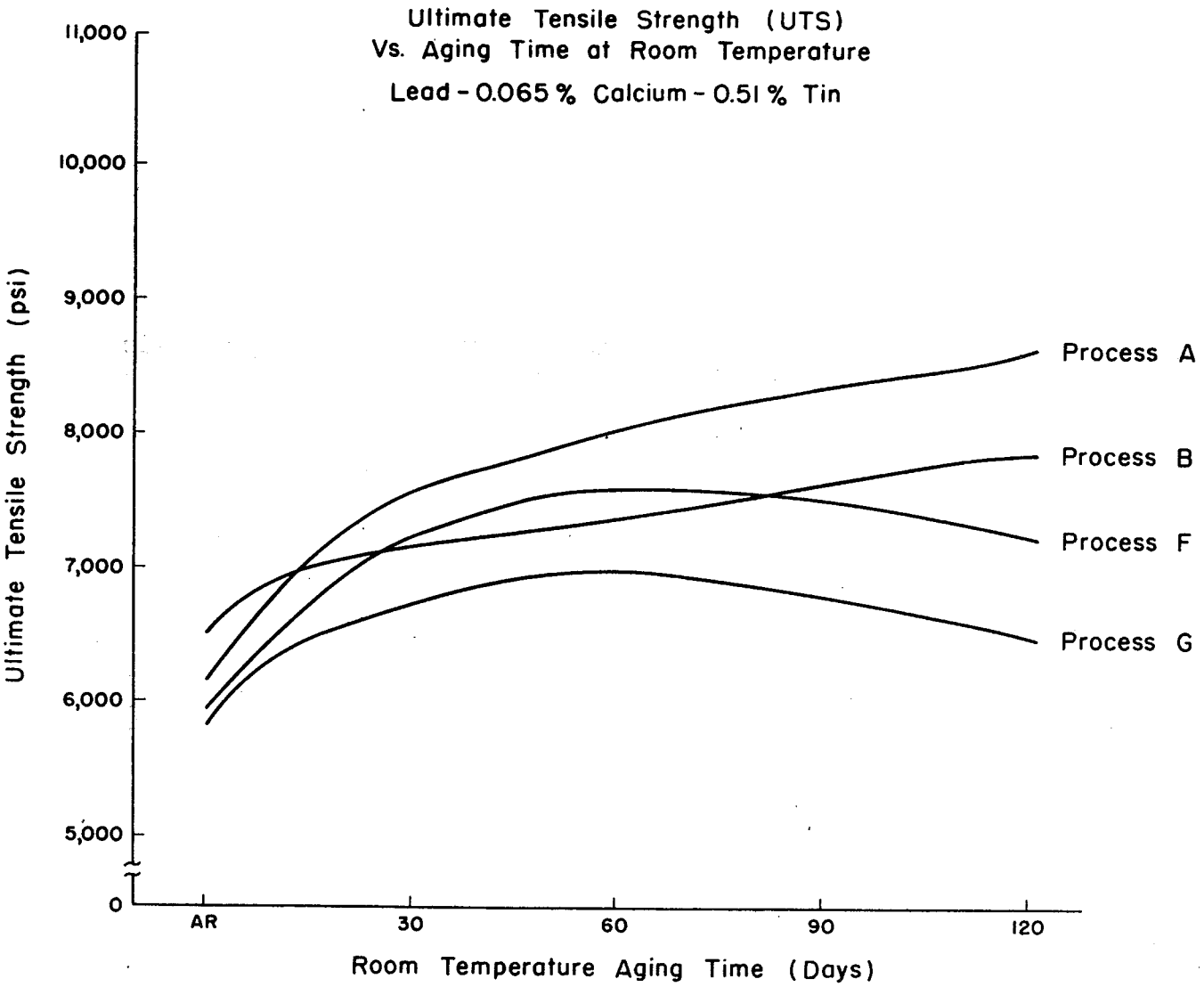

Ultimate Tensile Strength (UTS)
Vs. Aging Time at Room Temperature
Lead - 0.065 % Calcium - 0.51 % Tin Effect of Tin-to-Calcium Weight Ratio on the Ultimate Tensile Strength of Various Lead-Calcium-Tin Alloys in Sheet Form Cold Rolled Via Process A and Tested After Aging 120 Days at Room Temperature Effect of Tin-to-Calcium Weight Ratio on the Stress to Rupture Properties of Various Lead-Calcium-Tin Alloys in Sheet Form Cold Rolled Via Process A Effect of Elevated Temperature Exposure at 125°F on the Elevated Temperature Ultimate Tensile Strength of Lead - Calcium - Tin Sheet Cold Rolled Via Process A Typical Microstructure
Wrought Lead - Calcium - Tin Alloy Sheet Magnified 320 Diameters Lead - 0.068 % Calcium - 1.02 % Tin Alloy
Cold Rolled Via Process A to 0.040" Thick Effect of Solution Treatment of Aged Castings Prior to Cold Rolling Upon Ultimate Tensile Strength Stability Lead - 0.062 % Calcium - 1.36 % Tin

METHOD OF FABRICATING STABLE WROUGHT LEAD-CALCIUM-TIN ALLOYS BY MEANS OF COLD WORKING

This application is a continuation-in-part of U.S. application Serial No. 472,113, filed May 22, 1974, now abandoned; which application is a continuation-in-part of both U.S. application Serial No. 394,096, filed September 4, 1973, and U.S. application Serial No. 369,452, filed June 13, 1973, now both abandoned; which two applications are, respectively, a continuation and a division of U.S. application Serial No. 328,333, filed January 31, 1973, now abandoned; which application Serial No. 328,333 is a continuation-in-part of U.S. application Serial No. 72,825, filed September 16, 1970, now abandoned; which application Serial No. 72,825 is a continuation-in-part of U.S. application Serial No. 4,240, filed January 20, 1970, now abandoned.

The present invention relates to stable wrought lead-calcium-tin alloys and to a process for their preparation.

Lead-containing alloys are useful in a variety of fields, such as in the construction of batteries, sound attenuation, radiation shielding, chemical construction and architecture. Wrought alloys of lead, however, have heretofore had physical properties which are somewhat deficient in regard to strength, strength stability at room temperature, heat stability and stress-rupture or creep resistance depending upon the field of use. The mechanical and physical properties of importance vary in each end-use application. Wrought lead alloys used in the production of battery grids require a sufficient level of strength, strength stability and heat stability to allow processing at high speeds within a time period shortly after the initial working of the alloy. On the other hand, wrought alloys used in architecture, sound attenuation, radiation shielding, and similar structural applications require high strength levels, strength stability and heat stability over long periods of time. Thus, from a practical standpoint, wrought lead alloys must possess properties consistent with either manufacturing needs over an intermediate term or product needs over a longer time period.

It is, therefore, the primary object of the present invention to provide wrought alloys of lead which meet the aforementioned requirements of either intermediate or long range strength stability at room temperature and particularly having improved strength, heat stability, microstructure and stress-rupture or creep resistance.

In general, the present invention provides stable wrought alloys of lead by casting a lead-containing alloy having a particular calcium content and having particular relative and absolute tin contents, and thereafter cold working the casting within a particular limited time period after casting.

The control of the time period between casting and cold working is essential in order to produce wrought lead-calcium-tin alloys which have improved strength and strength stability at room temperature, i.e., the wrought alloys of the invention, depending upon the relative and absolute tin content, have strengths which become stable at room temperature during time intervals of up to about 120 days after manufacture ["intermediate stability"] or at least 2 years after manufacture ["long-range stability"] as opposed to wrought alloys having strengths at room temperature which decrease with time during the above-mentioned intervals after cold working. This time period between casting and cold working can be greater as the relative tin-to-calcium content is increased within specified limits of absolute tin content.

The tin-to-calcium weight ratio or relative tin content is important in order to produce wrought lead alloys not only having strength stability at room temperature but also having improved strength, heat stability and stress-rupture or creep resistance. Within absolute limits, these latter properties increase as the tin-to-calcium weight ratio increases.

It is also important that the absolute tin content be regulated, particularly so as not to exceed a maximum value, in order to achieve strength stability at room temperature.

More specifically, the present invention provides a process for the preparation of stable wrought alloys of lead which comprises casting an alloy consisting essentially of from about 0.02% or 0.03% to about 0.1% by weight of calcium, relative and absolute tin contents set forth hereinafter, and the balance substantially lead. It is preferred that the alloys have a calcium content of from about 0.045% to about 0.075% by weight. In these preferred embodiments, it will be appreciated that as a commercially practical matter, the concentration of calcium may not always be precisely controlled, preferred compositions nominally having a 0.045% to 0.075% concentration may actually include alloys in which about 0.03% to about 0.09% calcium is used. Significant strengthening and intermediate stability of the alloy can be achieved by having the tin present in an amount such that the tin-to-calcium weight ratio or relative tin content is from about 7:1 to 10:1. In order to achieve higher strength levels and long-range stability, it is preferred that the alloy contains tin in an amount such that the tin-to-calcium weight ratio or relative tin content is from more than 10:1 up to about 100:1, and more preferably is from more than 10:1 up to about 60:1 or from 10:1 up to about 25:1, and most preferably is from about 16:1 to about 40:1 or about 25:1. The preferred range is dependent upon the level of calcium content within the constraints of absolute tin content. The absolute tin content is from about 0.3 % to about 2.0% or from about 0.3% to about 1.0%, and preferably is from about 0.6% to about 1.8%, and, to achieve long-range stability in excess of 2 years, most preferably from about 1.0% to about 1.8% by weight of the alloy.

The cast alloys are cold worked within a particular limited time period after casting, which time period can be increased as the relative tin-to-calcium weight ratio is increased within specified limits of absolute tin content. Thus, the tin-containing lead-calcium alloys having a tin-to-calcium weight ratio of from about 7:1 to 10:1 can be cold worked within about 24 hours after casting, although more preferably within about 8 hours after casting, and most preferably within about 1 hour after casting, and the tin-containing lead-calcium alloys having a tin to calcium weight ratio of from more than 10:1 up to about 100:1 can be cold worked within about 48 hours after casting, although it is preferred that they be cold worked within about 24 hours after casting, and more preferably that they be cold worked within about 8 hours after casting because of the superior properties obtained thereby.

Conventional batch or continuous metallurgical techniques can be employed in the casting and cold working operations of the process of the invention. Cold working can include such techniques as rolling, extruding, forging and the like, with rolling being the preferred technique.

As is well known in the metallurgical arts, cold working involves the mechanical deformation of a work piece at a temperature low enough that dislocations caused by working are retained resulting in a metallurgical structure which consists primarily of nonrecrystallized deformed grains. By contrast, in hot working the temperature of the work piece is sufficiently high that dislocations caused by working are rapidly dissipated by annealing resulting in a metallurgical structure which consists primarily of recrystallized grains. The present invention depends on an interaction between the dislocations of cold working and the precipitated calcium-containing phases which gives rise to stable mechanical properties and a fine grained non-recrystallized microstructure. The absolute level of mechanical properties attained is dependent upon the amount of deformation of the work piece. The best results are obtained if the amount of cold working is equivalent to a deformation of about 4:1 [i.e., reducing a ½ inch strip by cold rolling to a thickness of ⅛ inch or less]. Lesser degrees of improvement are observed, however, with either more or less extensive cold working.

In the practice of this invention, the work piece is normally cold worked at a essentially room temperature or the existing ambient temperature of the shop. However, it will be obvious that any process of cold working tends to generate heat and results in raising somewhat the temperature of the work piece. As described herein, cold working the work piece at room temperature in ambient conditions may or may not involve effects to dissipate the heat generated by cold working, depending upon the rate and mode of working employed.

It will be appreciated from the foregoing that the present invention, however, is not limited to the cold working of freshly cast lead-calcium-tin alloys. Aged lead-calcium-tin castings or wrought products, even after all of the excess calcium-containing phases have precipitated, may be restored to a condition permitting working or reworking simply by heating such pieces to a temperature sufficient to redissolve the precipitated calcium-containing phases and then cooling again to ambient temperatures. Remelting and recasting is not necessary. This process of restoring lead-calcium-tin alloys so that they may be cold worked is referred to herein as "solution treatment."

Solution treatment consists of heating a previously aged cast or wrought work piece having an alloy composition of the type described herein to a temperature sufficiently high, and holding the work piece for a sufficiently long period of time, so that a substantial portion of the calcium-containing phases will re-enter into solid solution with the lead. If the alloy is then cooled to ambient conditions in a reasonable period of time, a super-saturated solid solution containing an excess of calcium-containing phases, just as in freshly cast material, will be produced and the solution-treated work piece will behave in a manner identical to that of a fresh casting.

As a general guide, it is sufficient to heat the lead-calcium-tin work piece to the temperature at which the calcium-containing phases are soluble in the lead for a reasonable period of time. As a simple guide to determining whether the calcium-containing phases have been redissolved, the hardness or strength of the solution-treated work piece may be compared with that of a freshly cast alloy of the same composition.

The solution treatment method is applicable to work pieces which have been cast and held in storage for a period of time too long to permit hardening and stabilization by cold working as described herein and, also, to work pieces which may have been cast and previously cold worked and which are to be subjected to further cold working, although of an age such that the excess calcium-containing phases have already precipitated.

In general, the work piece after casting or solution treatment may be laid in the open where it can cool by natural convection, although it is preferred that the work piece be cooled to room temperature as soon as is practical. Cold working of the work piece can then proceed in accordance with the delays between casting or solution treatment and working defined in my invention.

Figure 5:
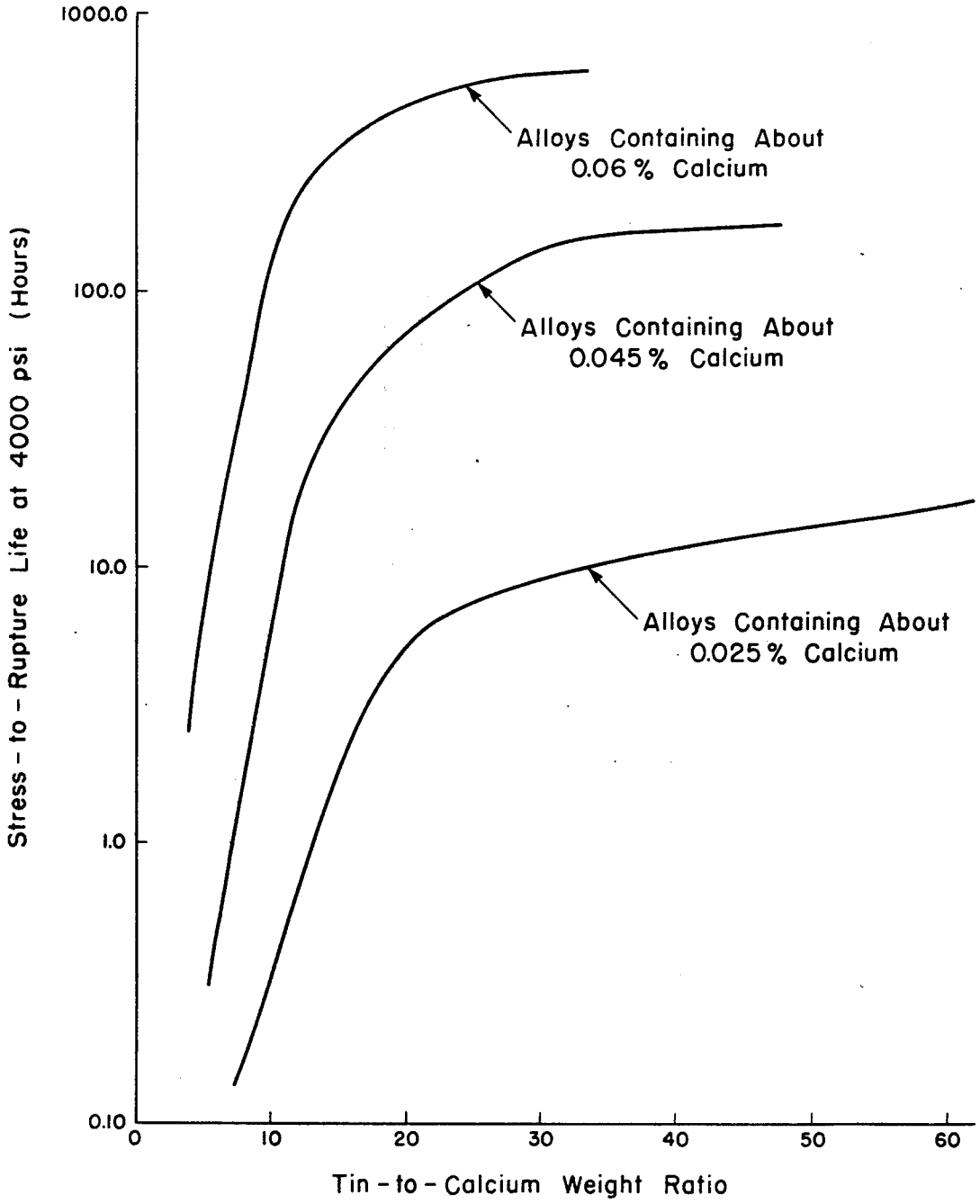
Figure 6:
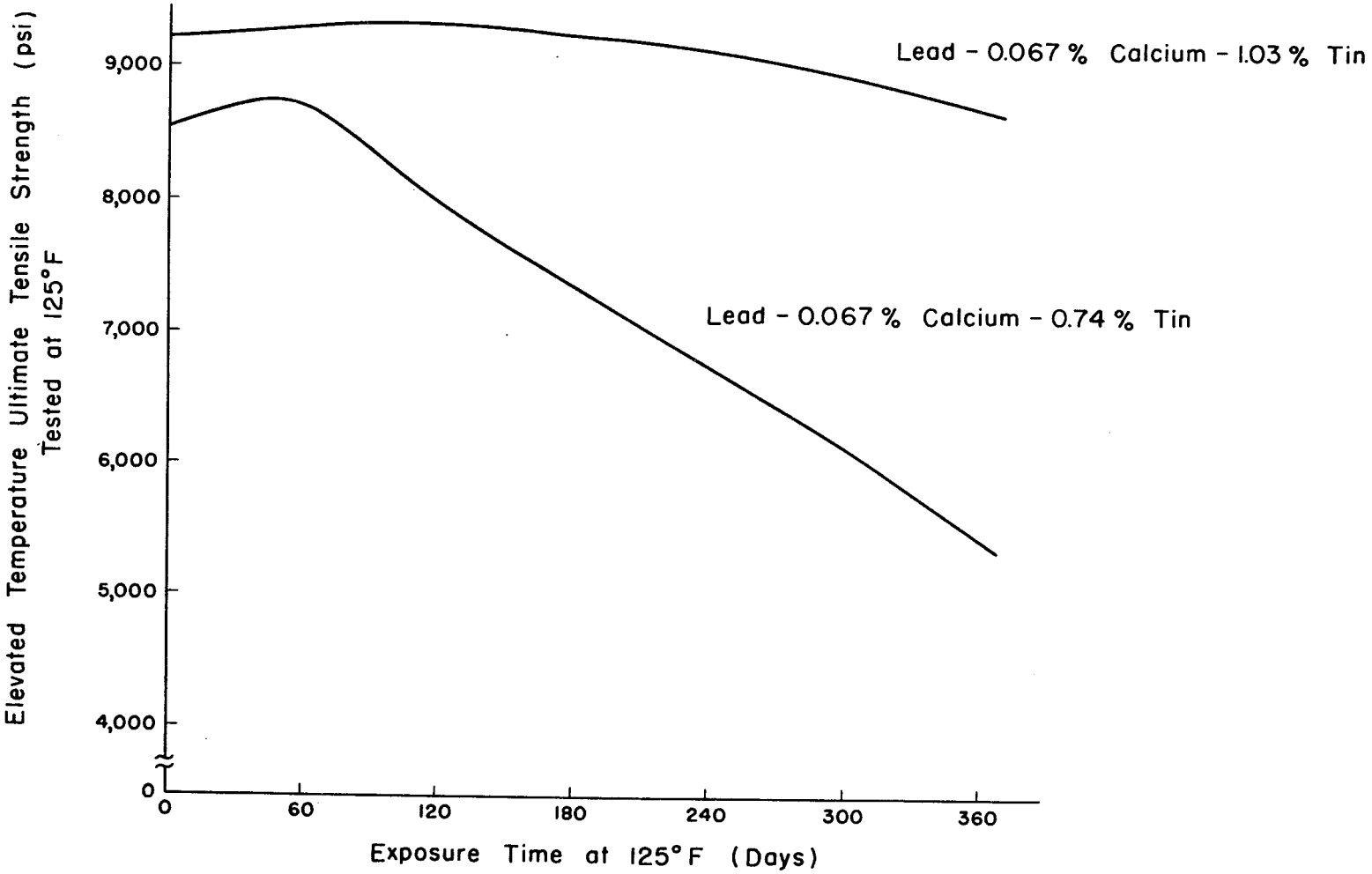
Figure 7:
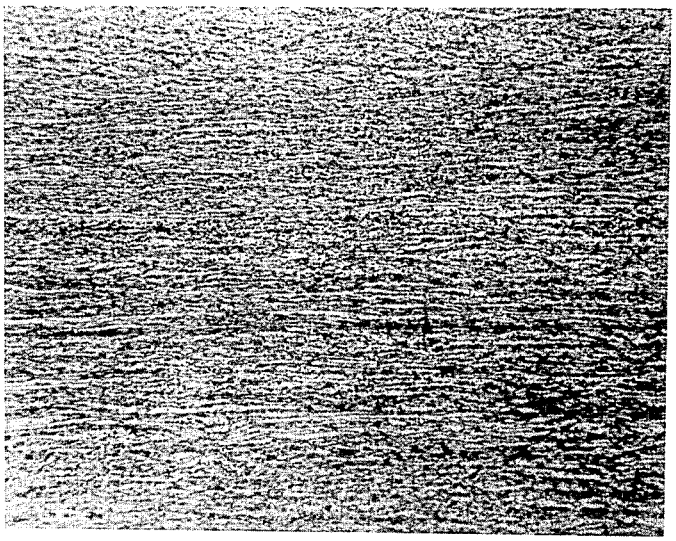

In the drawings,

FIGS. 1–6, 8 and 9 are graphs showing the effect of various conditions upon the properties of various Pb-Ca-Sn alloys and FIG. 7 is a photomicrograph showing a typical microstructure of a wrought Pb-Ca-Sn alloy.

EXAMPLES

Examples 1–3 illustrate the effect of various time delays between casting and cold working upon the stability and the level of mechanical properties of various lead-tin alloys. In each example, the lead component of the alloys was a Corroding Grade lead; the calcium component was commercial calcium having a purity of 99.5%; and the tin component was tin having a purity of 99.9%. The alloys were continuously cast on a pilot scale continuous caster. The cast slabs were 10 ½ inches wide and ¾ inch thick. In order to obtain satisfactory as-cast structures and surfaces, the ¾ inch thick castings were made at a casting temperature of about 700°F. The temperature was held as closely as possible during casting, but crude temperature control permitted variations of as much as ±10°F. during the length of a cast. The alloys were cast at a rate of 3 ½ feet per minute.

The cold working operation utilized in Examples 1–3 was cold rolling. Thus, the continuously cast alloys were cold rolled to 0.040 inch thick strip using a constant rolling pass schedule as follows: 0.500 inch, 0.350 inch, 0.200 inch, 0.120 inch, 0.065 inch, and 0.040 inch. The continuously cast slab was cold rolled to final gage after aging at room temperature for the time periods specified in each example. The behavior of the cold rolled sheet was evaluated on the basis of ultimate tensile strength and stress rupture (a short-term measure of creep resistance) properties during aging at room temperature. The ultimate tensile strength was measured using ASTM standard 1 inch gage length specimens and a testing speed of 0.5 inch per minute. The stress rupture or creep resistance testing was performed with 2 inch gage length specimens. All samples were prepared on a Tensil-Kut machine. All properties were measured in the longitudinal direction.

EXAMPLE 1

FIG. 1 shows the effect of time delays between casting and cold rolling of less than 8 hours (Process A), 24 hours (Process B), 7 days (Process F), and 14 days (Process G) on the ultimate tensile strength stability during a 120 day time interval of a lead-0.065% calcium-0.51% tin alloy. Here it may be seen that material having a tin-to-calcium weight ratio of from about 7:1 to 10:1, e.g., 7.8:1, cold rolled within 8 hours after casting (Process A) and material cold rolled within 24 hours after casting (Process B) increase gradually in tensile strength at room temperature during a 120 day time interval ("intermediate stability"). However, waiting 7 and 14 days (Processes F and G, respectively) between casting and cold rolling yields materials which appear to increase in physical properties for approximately 60 days and then proceed to diminish in tensile strength at room temperature.

Further, it may be seen in Table I that the process delay time also affects the level of stress rupture or creep resistance properties of this material. As the time between casting and cold rolling increases, the stress rupture properties decrease dramatically. Despite the fact that materials made by Processes A and B possessed tensile strength stability, it may be seen that this increase in time delay between 8 hours and 24 hours has caused a significant reduction in stress rupture properties. Thus, it is most desirable that this material be cold rolled immediately after casting.

TABLE I

The Effect of Time Delays Between Casting and Cold Rolling on the Stress Rupture Properties of Cold Rolled Lead-0.065% Calcium-0.51% Tin Alloy Strip

| Process | Time Delays | Time to Rupture at 3000 psi (Hours) |
|---|---|---|
| A | Less than 8 hours | 45 |
| B | 24 hours | 22 |
| F | 7 days | 6 |
| G | 14 days | 2 |

e.g., about 18.3:1, there was achieved by Processes A, B and C a stable tensile strength at room temperature (long-range stability) which was higher than that for the lower tin-containing alloys of Examples 1 and 2. These data show that a delay of up to 48 hours between casting and cold working by cold rolling does not result in decreasing properties, although the shorter the time delay, the stronger the alloy. However, waiting 5 days (Process E), 7 days (Process F) and 30 days (Process H) before cold rolling yields materials which reach maximum tensile strengths at room temperature considerably below the tensile strengths resulting from the other processes and which decrease in strength with time thereafter.

As in earlier examples, process delay times also have an effect upon the level of stress rupture or creep resistance properties of this material as shown in Table II. The stress rupture or creep resistance properties are affected by the time delay between casting and cold rolling to a much greater extent than are tensile strength properties and, although several processes were shown to produce stable properties, it is preferred that minimum time delays between casting and cold rolling be employed in order to provide maximum short-term tensile strength properties and resistance to creep.

TABLE II

The Effect of Time Delays Between Casting and Cold Rolling on the Stress Rupture Properties of Cold Rolled Lead-0.065% Calcium-1.19% Tin Alloy Strip

| Process | Time Delay | Time to Rupture at 3000 psi (Hours) |
|---|---|---|
| A | Less than 8 hours | 1000 |
| B | 24 hours | 300 |
| F | 7 days | 30 |
| H | 30 days | 20 |

EXAMPLE 2

Figure 2:
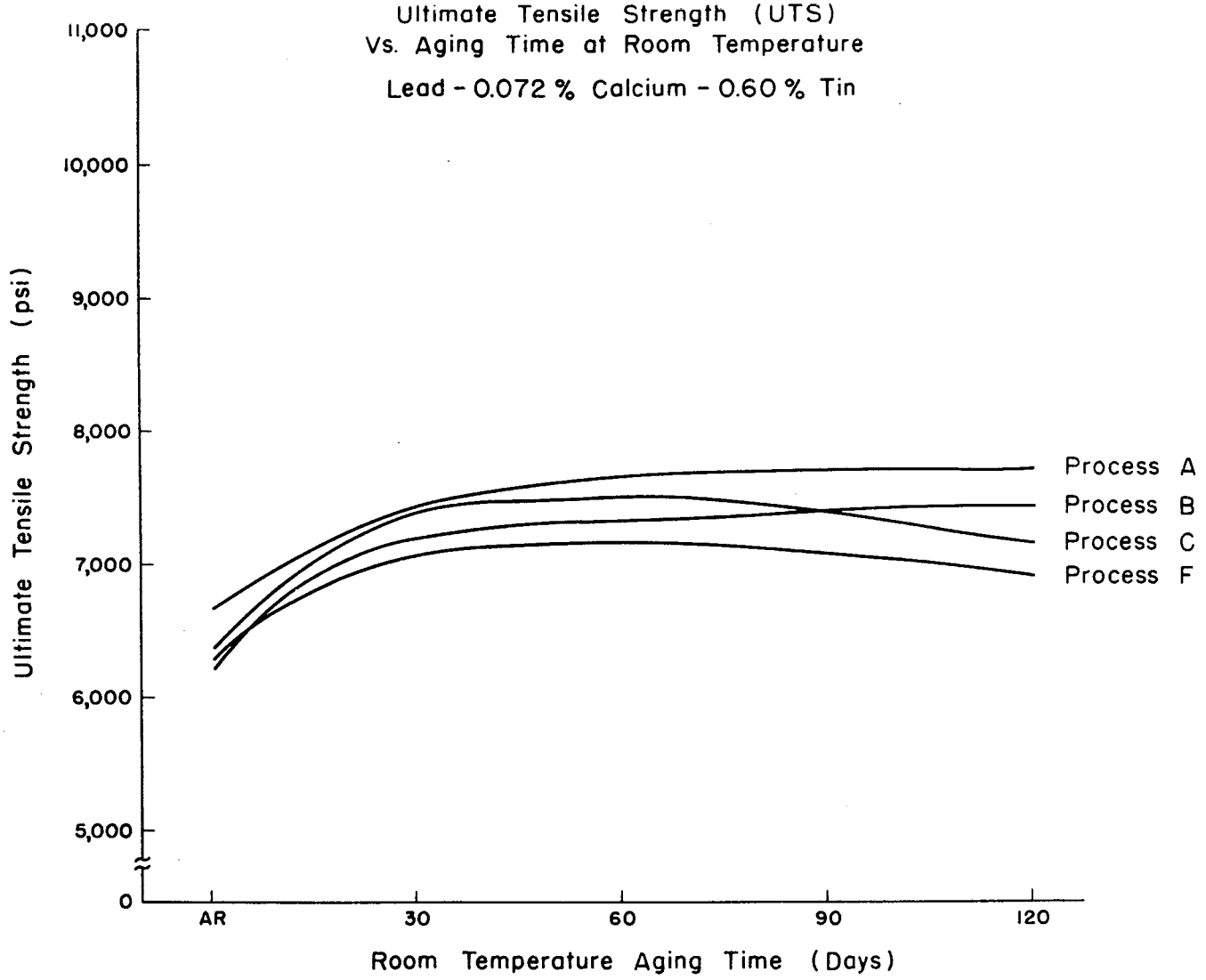

FIG. 2 shows the effect of time delays between casting and cold rolling of less than 8 hours (Process A), 24 hours (Process B), 48 hours (Process C), and 7 days (Process F) on the ultimate tensile strength stability during a 120 day time interval of a lead-0.072% calcium-0.60% tin alloy. Here it may be seen in a material having a tin-to-calcium weight ratio of from about 7:1 to 10:1 (e.g., 8.3:1) that time delays of within 8 hours (Process A) and 24 hours (Process B) between casting and cold rolling result in gradually increasing tensile strength at room temperature during a 120 day time interval (intermediate stability). However, time delays between casting and cold rolling of 48 hours and 7 days yield materials which appear to increase in physical properties for approximately 60 days and then proceed to diminish in tensile properties with time at room temperature. Thus, to insure stability and maximize mechanical property levels, it is most desirable that this material be cold rolled immediately after casting.

EXAMPLE 3

Figure 3:
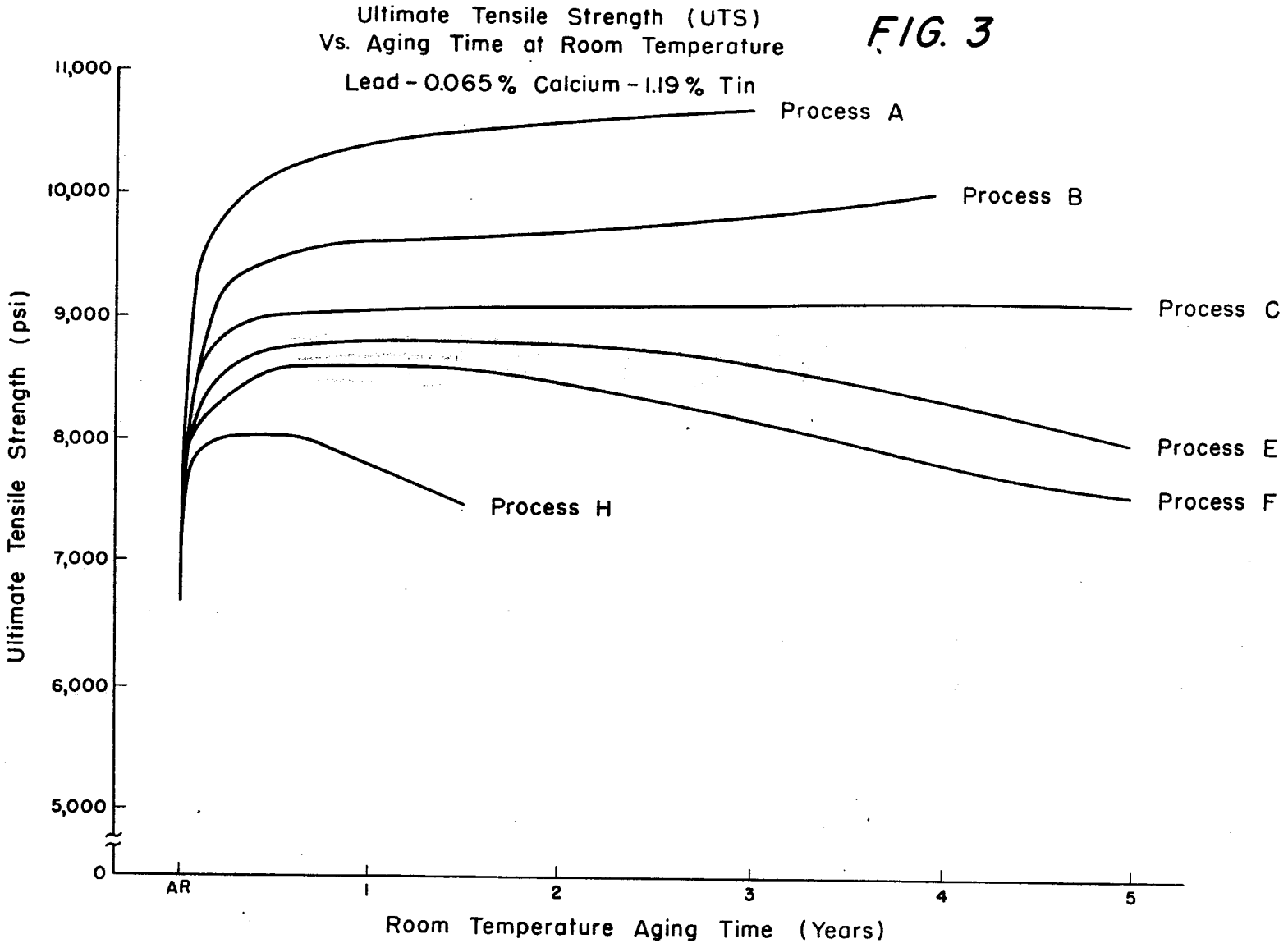
Figure 4:
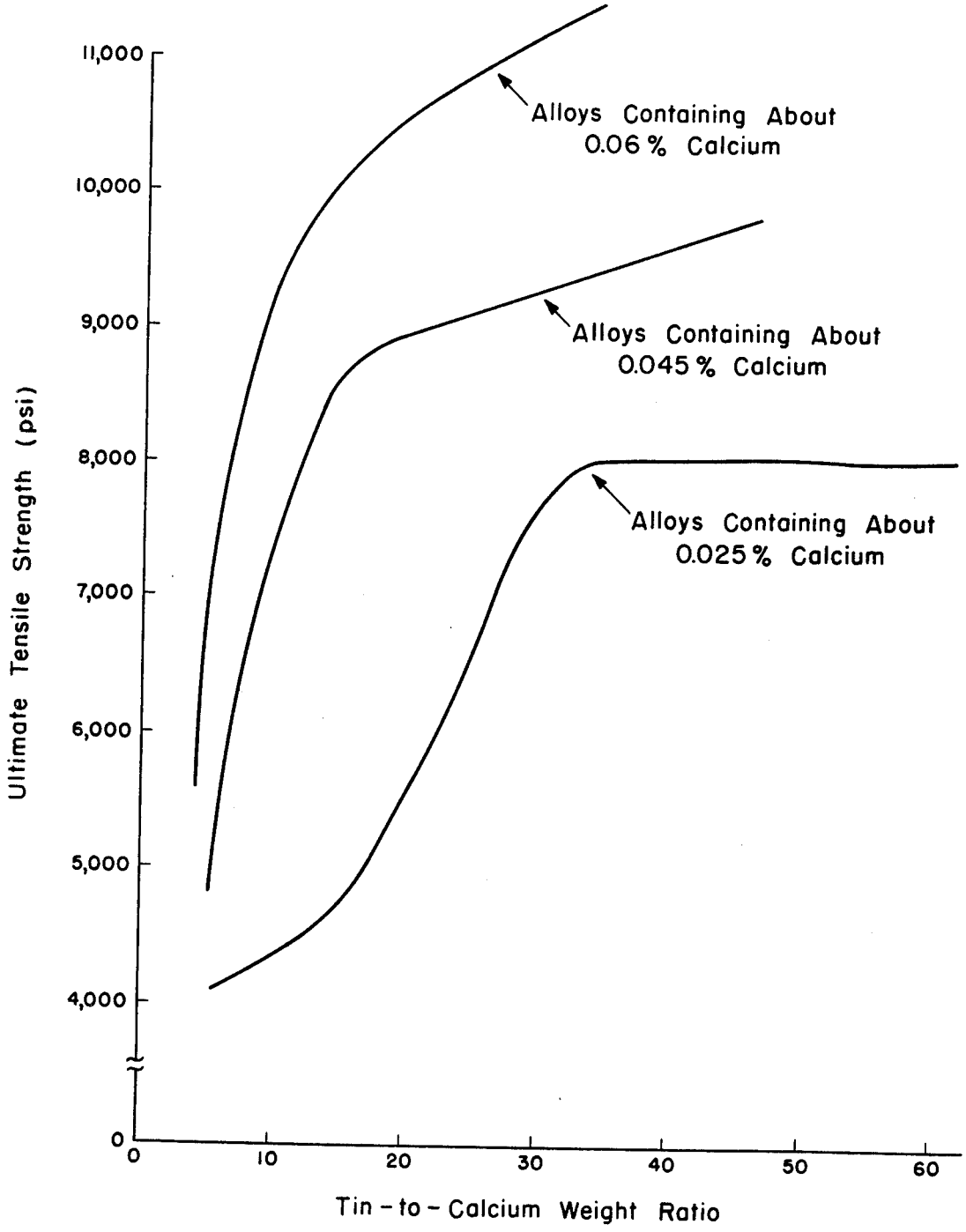

FIG. 3 shows the effect of time delays between casting and cold rolling of less than 8 hours (Process A), 24 hours (Process B), 48 hours (Process C), 5 days (Process E), 7 days (Process F) and 30 days (Process H) on the ultimate tensile strength stability during a 5 year time interval of a lead-0.065% calcium-1.19% tin alloy. In this tin-containing alloy having a tin-to-calcium weight ratio of from more than 10:1 up to about 100:1, Examples 4–18 in Tables III–V, combined with FIGS. 4 and 5, illustrate the effect of alloy chemistry and specifically the tin-to-calcium weight ratio or relative tin content upon the level of mechanical properties of various lead-calcium-tin alloys. In each example, the lead component of the alloys was a Corroding Grade lead; the calcium component was commercial calcium having a purity of 99.5%; and the tin component was tin having a purity of 99.9%. The alloys were continuouly cast on a pilot scale continuous caster. The cast slabs were 10 ½ inches wide and ½ inch thick. In order to obtain satisfactory as-cast structures and surfaces, the ½ inch thick castings were made at a casting temperature of about 720°F. The temperature was held as closely as possible during casting, but crude temperature control permitted variations of as much as ±10°F. during the length of a cast. The alloys were cast at a rate of 3 ½ feet per minute.

The cold working operation utilized in Examples 4–18 of Tables III-V and in FIGS. 4 and 5 was cold rolling. The continuously cast alloys were cold rolled at 0.030 inch and/or 0.050 inch thick strip using the preferred process (Process A) within ½ hour after casting using a constant rolling pass schedule as follows: 0.350 inch, 0.225 inch, 0.120 inch, 0.060 inch, 0.050 inch and 0.030 inch. The materials were then evaluated in the manner described for Examples 1–3.

EXAMPLES 4–18

The data shown in Tables III–V give the ultimate tensile strength after aging periods up to 720 days at room temperature of various wrought lead-calcium-tin alloys produced by Process A wherein the relative and absolute tin contents were varied at three different nominal calcium levels. The data confirm that the wrought lead-calcium-tin alloys possessing tin-to-calcium weight ratios or relative tin contents of more than 10:1 possess stable properties through 720 days, providing that the absolute tin content does not exceed about 2.0%. Examples 4–8, 10–12 and 14–16, with tin-to-calcium weight ratios or relative tin contents of from 10:1 up to about 60:1, possessed stable properties and are therefore considered within the scope of this invention. In contrast, comparative Examples 9, 13, 17 and 18 were included for illustration purposes as these materials are unstable and therefore are not considered within the scope of this invention because the absolute tin level exceeded about 2.0% by weight. While the data in the Tables III-V illustrate stable properties up to a ratio of about 60:1, it may be expected that a 0.02% by weight calcium alloy possessing a tin-to-calcium weight ratio or relative tin content of about 100:1 can possess stable properties without exceeding the absolute level of tin defined in this invention.

TABLE III

| Nominal Lead - 0.025% Calcium-Tin Alloys | | | | | | | | | |
|---|---|---|---|---|---|---|---|---|---|
| Example No. | Sn/Ca | %Ca | %Sn | 1 | 30 | 60 | 120 | 360 | 720 |
| 4 | 10.0:1 | 0.030 | 0.30 | 3600 | 4000 | 4000 | 4200 | 4600 | 5300 |
| 5 | 16.0:1 | 0.028 | 0.43 | 4200 | 5000 | 5100 | 4900 | 5500 | 6300 |
| 6 | 22.3:1 | 0.026 | 0.58 | 4700 | 4900 | 5300 | 6000 | 5900 | 7000 |
| 7 | 32.3:1 | 0.021 | 0.97 | 6200 | 6800 | 7500 | 8000 | 8400 | 8500 |
| 8 | 61.4:1 | 0.021 | 1.29 | 6500 | 7300 | 7400 | 8100 | 8400 | 8600 |
| 9 | 147.0:1 | 0.017 | 2.52 | 6800 | 7200 | 7900 | 8100 | 7700 | 6200 |

TABLE IV

| Nominal Lead - 0.045% Calcium-Tin Alloys | | | | | | | | | |
|---|---|---|---|---|---|---|---|---|---|
| | | | | Days | | | | | |
| Example No. | Sn/Ca | %Ca | %SN | 1 | 30 | 60 | 120 | 360 | 720 |
| 10 | 11.3:1 | 0.044 | 0.50 | 5700 | 6300 | 6900 | 7900 | 7800 | 8100 |
| 11 | 17.3:1 | 0.042 | 0.73 | 6200 | 7100 | 7700 | 8900 | 8900 | 8900 |
| 12 | 27.2:1 | 0.043 | 1.17 | 6300 | 7300 | 9000 | 9300 | 9200 | 9800 |
| 13 | 50.4:1 | 0.049 | 2.47 | 8600 | 10500 | 10900 | 10000 | 9700 | 7400 |

TABLE V

| Nominal Lead - 0.06% Calcium-Tin Alloys | | | | | | | | | |
|---|---|---|---|---|---|---|---|---|---|
| | | | | Days | | | | | |
| Example No. | Sn/Ca | %Ca | %Sn | 1 | 30 | 60 | 120 | 360 | 720 |
| 14 | 15.3:1 | 0.065 | 1.00 | 6800 | 10200 | 10200 | 10300 | 9900 | 1070 |
| 15 | 22.7:1 | 0.061 | 1.39 | 7000 | 10100 | 10400 | 10300 | 10300 | 10800 |
| 16 | 33.0:1 | 0.055 | 1.81 | 8000 | 10500 | 11200 | 11500 | 10200 | — |
| 17 | 83.5:1 | 0.055 | 4.59 | 9200 | 9800 | 8500 | 6500 | 6200 | 5700 |
| 18 | 115.0:1 | 0.055 | 6.32 | 9100 | 7200 | 6300 | 5700 | 5800 | 5400 |

FIGS. 4 and 5 show the effect of the tin-to-calcium weight ratio or relative tin content upon the level of properties achieved. These curves show that the tin-to-calcium weight ratio or relative tin content is one of the key parameters of the process of this invention in determining the maximum properties achievable upon room temperature aging. FIG. 4 is a plot of the tin-to-calcium weight ratio versus the ultimate tensile strength at room temperature for alloys produced in accordance with procedures defined above for Examples 4 to 18. These data show that, by using the tin-to-calcium weight ratio as the controlled variable at each absolute level of calcium, the properties can be improved upon by increasing the tin-to-calcium weight ratio or relative tin content within the absolute limits of tin content. FIG. 4, taken together with Tables III–V, demonstrates that the tin-to-calcium weight ratio or relative tin content can be from more than about 10:1 up to the limit of absolute tin content, e.g., about 100:1, and should be more than 10:1 up to about 60:1 or 10:1 up to about 25:1 and more preferably from about 16:1 to about 40:1, the preferred range being dependent upon the level of calcium content and within the constraints of absolute tin content, in order to maximize the ultimate tensile strength level at room temperature of the aged wrought lead-calcium-tin alloys.

It will be obvious to those knowledgeable in the applications for lead and lead alloy sheet that the properties achieved in these products are considerably above those normally associated with conventional lead alloys. It has been shown that, by proper control of alloy chemistry and delay times between casting and cold rolling, stable ultimate tensile strength levels above 8,000 psi may be produced in a variety of differing alloys. In contrast, the product heretofore known in the trade as hard lead, a rolled lead-6% antimony alloy, possesses tensile properties of about 4,500 to 5,000 psi. It is therefore not only significant that stability in this alloy system has been achieved, but also that the products produced thereby possess stable ultimate strengths considerably higher than those of any other known wrought lead based alloy.

FIG. 5 is a plot of the tin-to-calcium weight ratio versus the stress rupture life or creep resistance at room temperature for alloys produced in accordance with the procedures defined previously for Examples 4 to 18. These data show that, by using the tin-to-calcium weight ratio as the controlled variable, the properties can be significantly improved upon as was the case with ultimate tensile strength. FIG. 5 partially demonstrates that the tin-to-calcium weight ratio or relative tin content can be from more than 10:1 up to about 100:1 and should be more than 10:1 up to about 60:1 or 10:1 up to about 25:1 and more preferably in the range of about 16:1 to about 40:1, the preferred range being dependent upon the level of calcium content within the constraints of absolute tin content, in order to maximize stress rupture or creep properties.

As in the case of tensile strength considerations, it should be apparent to those knowledgeable in the applications, of lead alloy sheet that the creep resistance demonstrated in the alloys of this invention is vastly superior to that achieved in other wrought products such as hard lead, a rolled lead-6% antimony alloy. The stress rupture life of rolled lead-antimony sheet at 4,000 psi is less than 1 hour whereas, as has been shown in FIG. 5, stress rupture lives of as high as about 600 hours may be achieved within the scope of this invention at that stress level. Thus the improvement in creep resistance or stress rupture properties over that of any other known wrought lead based alloys is considerable.

FIG. 4, combined with Tables III–V, illustrates further that the strength properties of the wrought lead-calcium-tin alloys increase as the absolute levels of calcium and tin increase, up to the maximum absolute limits. This may become manifest by comparing Examples 5, 11 and 14 and Examples 6, 12 and 15 wherein the tin-to-calcium weight ratios were substantially alike, e.g., about 16:1 and about 24:1, respectively. In each of these comparisons, it is notable that tensile strength is significantly improved as absolute calcium and tin contents become greater and that this is especially true at calcium contents greater than about 0.04% calcium and absolute tin contents greater than about 1.0% tin. This same relationship holds true for stress rupture or creep resistance properties.

Another facet of lead-calcium-tin alloys, namely improved stability at temperatures greater than ambient is shown by way of Example 19.

EXAMPLE 19

Two lead-calcium-tin alloys, possessing alloy chemistries of lead-0.067% calcium-0.74% tin and lead-0.067% calcium-1.03% tin, were produced via the preferred Process A time delays; were cold rolled in 7 passes from 0.750 inch thick billet to a final gauge in the range of 0.030 inch – 0.055 inch; and were then aged for more than 120 days. The strip was then heat treated at a constant temperature of 125°F. in an ethylene glycol bath for various time periods up to 1 year. Tensile tests were then performed at each time interval at a temperature of 125°F.

FIG. 6 demonstrates the effect of the elevated temperature exposure on each of the alloys. Incremental additions of tin corresponding to tin-to-calcium weight ratios or relative tin contents of 11.0:1 and 15.4:1, respectively, showed improved stability. Thus it is expected that lead-calcium-tin alloys having a tin-to-calcium weight ratio of from about 10:1 to about 100:1 are increasingly heat stable as the relative and absolute tin contents increase. Practically, the behavior of the more heat resistant alloys is substantially better than that experienced for more conventional wrought lead alloys such as hard-lead, e.g., lead-6% antimony, and thus broader applications areas may be served.

It will be appreciated by those skilled in the art that achievement of the stability and superior level of ultimate tensile strength and stress-to-rupture life exhibited by the wrought lead-calcium-tin alloys of the invention is dependent upon establishing a stable microstructure which is not subject to recrystallization and grain growth upon aging at room temperature. This is in contrast to unstable wrought materials having properties which decrease and microstructures which change with time during the previously described time intervals after cold working.

Metallographic analysis has shown that the wrought alloys of the invention possess a microstructure which consists of a majority of relatively small, elongated or nonequiaxed, non-recrystallized grains oriented in the direction of cold working and which remain unchanged, i.e., resistant to grain recrystallization and grain growth, upon aging at room temperature for the time periods previously described. A typical example of the microstructural characteristics of a lead-0.068% calcium-1.02% tin alloy is shown in FIG. 7.

While the stability of microstructure is unique and is directly related to the stability of mechanical properties and therefore to the alloy compositions and process constraints set forth herein for wrought lead-calcium-tin alloys, it will be appreciated that the absolute microstructural character is dependent upon the absolute and relative amounts of the alloying constituents, e.g., as calcium content and the tin-to-calcium weight ratio increase, the average grain size decreases, and upon the total amount of cold working employed in processing, e.g., as the amount of cold working increases, the average grain size decreases and the directionality of structure increases. In the preferred embodiments of this invention, a stable microstructure consisting of a majority of very fine, elongated, nonequiaxed, non-recrystallized grains is exemplified; from a practical standpoint, this is most desirable in order to achieve uniform, nonpenetrating corrosive attack in the many application areas where lead is used for corrosion resistance.

Examples 20 and 21 illustrate the application of solution treatment prior to cold working to achieve stable properties and microstructures in aged work pieces.

EXAMPLE 20

Figure 8:
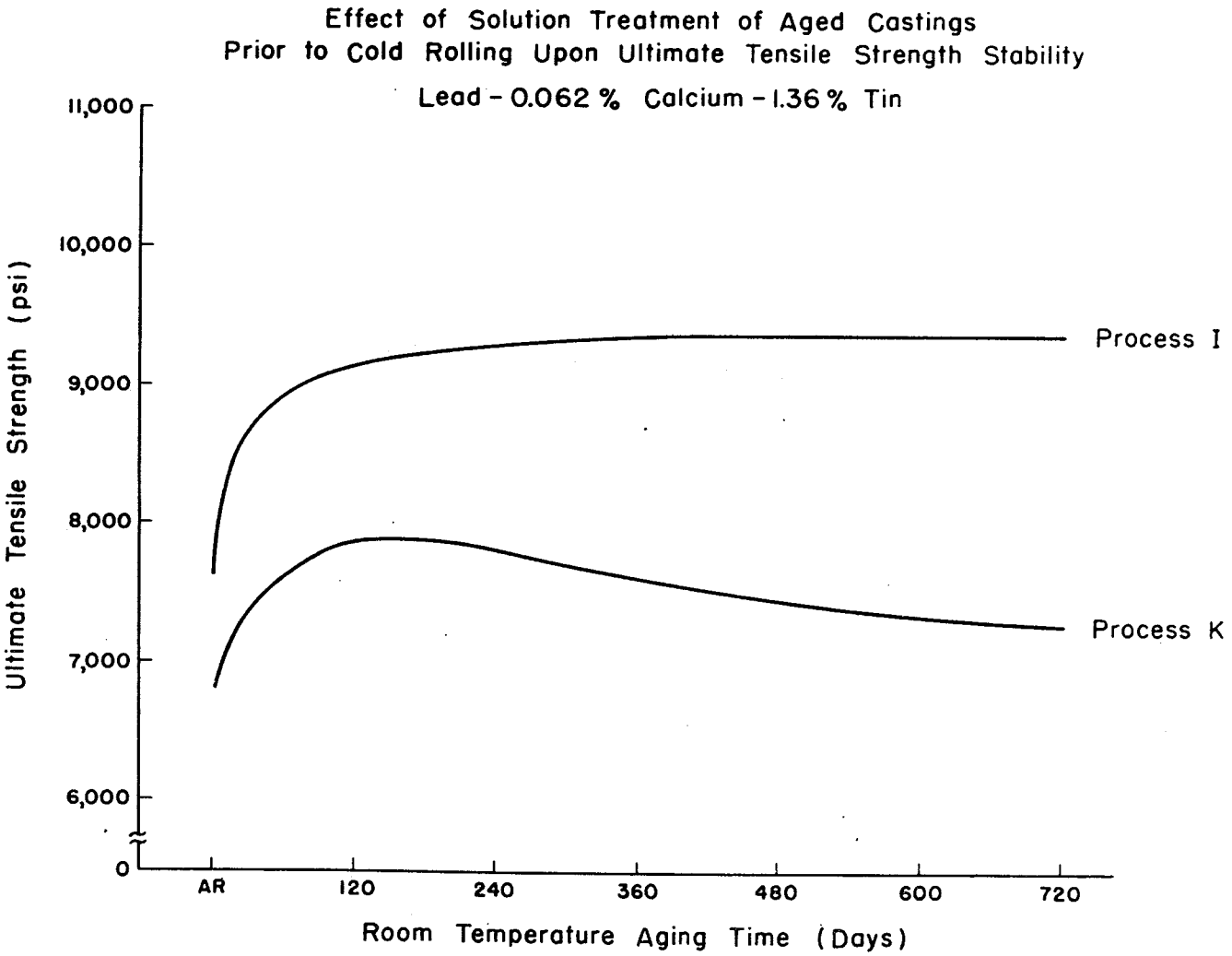

FIG. 8 illustrates that solution treatment can be utilized to achieve stable tensile properties in a lead-calcium-tin alloy having at tin-to-calcium weight ratio or relative tin content of more than 10:1 to about 100:1 and further illustrates, by comparison with FIG. 3, the similarity in behavior between the characteristics of solution-treated material and those of freshly cast material which have been cold worked within 8 hours after either casting or heat treatment.

In this example, a lead-0.062% calcium-1.36% tin alloy having a tin-to-calcium weight ratio or relative tin content of more than 10:1 to about 100:1, e.g., 21.9:1, was continuously cast in the form of a 2 inch × 11 inch slab in accordance with the procedures described previously and aged for 60 days at room temperature. One sample of the aged casting was then solution treated for 2 hours at a temperature of 600°F. and rapidly cooled to room temperature to achieve a supersaturated solid solution and cold rolled to a thickness of 0.031 inch within 1 hour after the cooling thereof [Process I]. A second sample of the slab aged for 60 days was cold rolled via the same procedure to the same gage without having a solution treatment [Process K]. Both materials were tested for tensile strength using standard 1 inch gage length specimens and a testing speed of 0.5 inch per minute. All samples were prepared using a Tensil-Kut machine.

The comparative tensile strengths of these two samples measured over a period of 720 days after cold rolling show that the properties of the solution-treated material [Process I] remained stable for 720 days [long-range stability] after cold rolling whereas the material which was cold rolled after aging for 60 days at room temperature without solution treatment [Process K] reached a peak in tensile strength at approximately 120 days and then gradually decreased in strength throughout the remainder of the 720 day period. In addition, the level of the stress-to-rupture properties was affected by solution treatment; material produced via solution treatment and cold rolling [Process I] possessed a stress-to-rupture life of 147 hours at a stress level of 4,000 psi whereas material produced from aged and nonsolution treated slab [Process K] possessed a considerably lower stress-to-rupture life of 1.7 hours at the same stress level.

EXAMPLE 21

Figure 9:
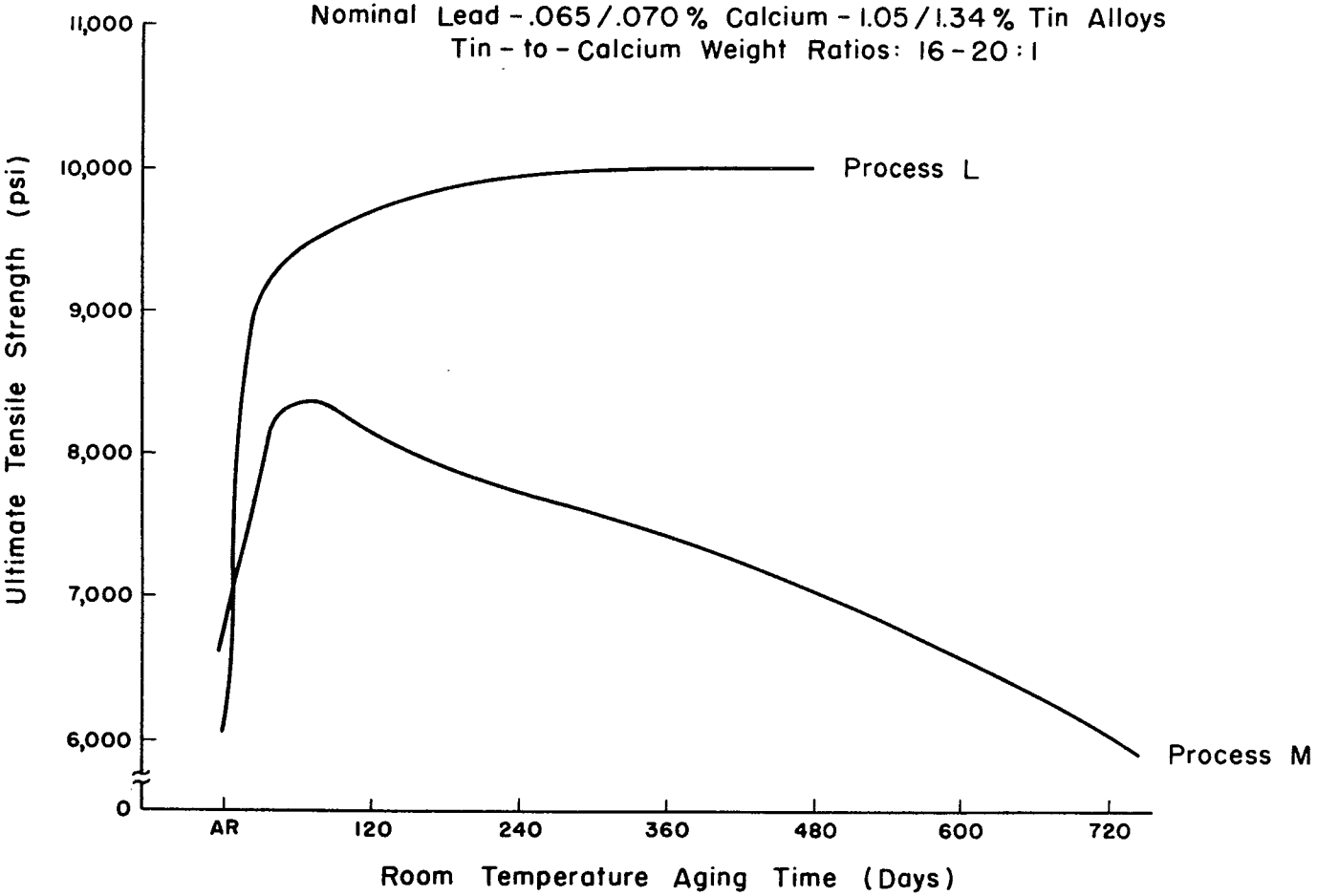

FIG. 9 illustrates that solution treatment can be utilized to achieve stable tensile properties in a previously worked and aged work piece which is to be subjected to reworking.

In this example, two alloys having comparable tin-to-calcium weight ratios or relative tin contents of 16:1 to 20:1 [lead-0.065% calcium-1.05% tin and lead-0.070% calcium-1.34% tin] were continuously cast in the form of slab ¾ inch thick × 14 ¾ inch wide and were rolled within 8 hours after casting to a thickness of 0.125 inch. After aging for about 750 days at room temperature, the lead-0.070% calcium-1.34% tin alloy sheet was solution treated and cold rolled to 0.020 inch within 8 hours of the cooling thereof [Process L]. In contrast, after aging for only about 180 days at room temperature, the lead-0.065% calcium-1.05% tin alloy sheet was cold rerolled without any solution treatment to 0.015 inch [Process M].

The comparative tensile strengths of these two samples measured over a period of more than 360 days after cold rerolling show that the properties of the material which was solution treated after aging for about 750 days [Process L] remained stable for more than 360 days after cold rerolling whereas the material which was cold rerolled after aging for 180 days without benefit of solution treatment [Process M] reached a peak in tensile strength after 60 days and then decreased in strength throughout the remainder of the 720 day period.

This further illustrates that solution treatment is applicable to an aged work piece, either aged castings or aged wrought stock, and that stable property behavior similar to that noted for fresh castings may be achieved through this embodiment of the invention.

It will be noted that the ordinate for FIGS. 1–4, 6, 8 and 9 is on a linear scale whereas the ordinate for FIG. 5 is on a logarithmic scale.

In summary of the foregoing alloy information, the cold worked lead-calcium-tin ternary alloys of the invention are characterized by strength stability and microstructural stability at room temperature. The cold worked lead-calcium-tin alloys having a low tin to calcium weight ratio or relative tin content of from about 7:1 to 10:1 and an absolute tin content of from about 0.3% to about 1.0% by weight are generally further characterized by having a stable ultimate tensile strength at room temperature of at least about 6,000 psi., a stable stress-to-rupture life at room temperature of at least 25 hours at a stress level of 3,000 psi., and a stable, fine grained, worked, non-recrystallized microstructure at room temperature. The cold worked lead-calcium-tin alloys having a high tin to calcium weight ratio or relative tin content of from more than 10:1 up to about 100:1 and an absolute tin content of from about 0.3% to about 2.0% by weight are generally further characterized by having a stable ultimate tensile strength at room temperature of at least about 6,500 psi., a stable stress-to-rupture life at room temperature of at least 5 hours at a stress level of 4,000 psi. and a stable, fine grained, worked, non-recrystallized microstructure at room temperature. The cold worked lead-calcium-tin alloys having a tin to calcium weight ratio or relative tin content of from more than 10:1 to about 60:1 and an absolute in content of from about 0.6% to about 1.8% by weight are generally further characterized by having a stable ultimate tensile strength at room temperature of at least about 8,500 psi., a stable stress-to-rupture life at room temperature of at least 30 hours at a stress level of 4,000 psi., and a stable, fine grained, worked, non-recrystallized microstructure at room temperature. The cold worked lead-calcium-tin alloys having a tin to calcium weight ratio or relative tin content of from about 16:1 to about 40:1 and an absolute tin content of from about 1.0% to about 1.8% by weight are generally further characterized by having a stable ultimate tensile strength at room temperature of at least about 9,000 psi., a stable stress-to-rupture life at room temperature of at least 100 hours at a stress level of 4,000 psi. and a stable, fine grained, worked, non-recrystallized microstructure at room temperature. The cold worked lead-calcium-tin alloys having a tin to calcium weight ratio or relative tin content of about 25:1 and an absolute tin content of from about 1.0% to about 1.8% by weight are generally further characterized by having a stable ultimate tensile strength at room temperature of at least about 10,000 psi., a stable stress-to-rupture life at room temperature of at least 300 hours at a stress level of 4,000 psi. and a stable, fine grained, worked, non-recrystallized microstructure at room temperature.

It will be appreciated that various modifications and changes may be made in the process and alloys of the invention, in addition to those set forth above, by those skilled in the art without departing from the essence of the invention and that, accordingly, the invention is to be limited only within the scope of the appended claims.

What is claimed is:

1. A process for the preparation of stable wrought alloys of lead which comprises casting an alloy consisting essentially of from about 0.02% to about 0.1% by weight of calcium, tin in an amount such that the tin to calcium weight ratio or relative tin content is from about 7:1 to 10:1 and the absolute tin content is from about 0.3% to about 1.0% by weight, and the balance substantially lead; and cold working the casting at a time period of within about 24 hours after the casting thereof.

2. The process as defined by claim 1 wherein the alloy has a calcium content of from about 0.045% to about 0.075% by weight.

3. The process as defined by claim 1 wherein the casting is cold worked at a time period of within about 8 hours after the casting thereof.

4. The process as defined by claim 1 wherein the casting is cold worked at a time period of within about 1 hour after the casting thereof.

5. A process for the preparation of stable wrought alloys of lead which comprises casting an alloy consisting essentially of from about 0.02% to about 0.1% by weight of calcium, tin in an amount such that the tin to calcium weight ratio or relative tin content is from more than 10:1 up to about 100:1 and the absolute tin content is from about 0.3% to about 2.0% by weight, and the balance substantially lead; and cold working the casting at a time period of within about 48 hours after the casting thereof.

6. The process as defined by claim 5 wherein the alloy has a calcium content of from about 0.045% to about 0.075% by weight.

7. The process as defined by claim 5 wherein the tin to calcium weight ratio or relative tin content is from more than 10:1 up to about 60:1 and the absolute tin content is from about 0.6% to about 1.8% by weight.

8. The process as defined by claim 5 wherein the tin to calcium weight ratio or relative tin content is from about 16:1 to about 40:1 and the absolute tin content is from about 1.0% to about 1.8% by weight.

9. The process as defined by claim 5 wherein the tin to calcium weight ratio or relative tin content is about 25:1.

10. The process as defined by claim 5 wherein the casting is cold worked at a time period of within about 24 hours after the casting thereof.

11. The process as defined by claim 5 wherein the casting is cold worked at a time period of within about 8 hours after the casting thereof.

12. The process as defined by claim 5 wherein the alloy is continuously cast and the casting is cold worked by cold rolling at a time period of within about 48 hours after the casting thereof.

13. A process for the preparation of stable wrought alloys of lead which comprises continuously casting an alloy consisting essentially of from about 0.03% to about 0.1% by weight of calcium, tin in an amount such that the tin to calcium weight ratio or relative tin content is from 10:1 up to about 25:1 and the absolute tin content is from about 0.3% to about 2.0% by weight, and the balance substantially lead; and cold rolling the casting at a time period of within about 24 hours after the casting thereof.

14. A process for the preparation of stable wrought alloys of lead which comprises heating an aged work piece of an alloy consisting essentially of from about 0.02% to about 0.1% by weight of calcium, tin in an amount such that the tin to calcium weight ratio or relative tin content is from about 7:1 to 10:1, and the absolute tin content is from about 0.3% to about 1.0% by weight, and the balance substantially lead, said heating being at a temperature and for a time sufficient to place a substantial portion of the calcium-containing phases in solid solution in the lead; cooling the work piece to ambient temperature to form a super-saturated solid solution of the calcium-containing phases in the lead; and cold working the work piece at a time period of within about 24 hours after the cooling thereof.

15. The process as defined by claim 14 wherein the alloy has a calcium content of from about 0.045% to about 0.075% by weight.

16. The process as defined by claim 14 wherein the work piece is cold worked at a time period of within about 8 hours after the cooling thereof.

17. The process as defined by claim 14 wherein the work piece is cold worked at a time period of within about 1 hour after the cooling thereof.

18. A process for the preparation of stable wrought alloys of lead which comprises heating an aged work piece of an alloy consisting essentially of from about 0.02% to about 0.1% by weight of calcium, tin in an amount such that the tin to calcium weight ratio or relative tin content is from more than 10:1 up to about 100:1 and the absolute tin content is from about 0.3% and about 2.0% by weight, and the balance substantially lead, said heating being at a temperature and for a time sufficient to place a substantial portion of the calcium-containing phases in solid solution in the lead; cooling the work piece to ambient temperature to form a super-saturated solid solution of the calcium-containing phases in the lead; and cold working the work piece at a time period of within about 48 hours after the cooling thereof.

19. The process as defined by claim 18 wherein the alloy has a calcium content of from about 0.045% to about 0.075% by weight.

20. The process as defined by claim 18 wherein the tin to calcium weight ratio or relative tin content is from more than 10:1 up to about 60:1 and the absolute tin content is from about 0.6% to about 1.8% by weight.

21. The process as defined by claim 18 wherein the tin to calcium weight ratio or relative tin content is from about 16:1 to about 40:1 and the absolute tin content is from about 1.0% to about 1.8% by weight.

22. The process as defined by claim 18 wherein the tin to calcium weight ratio or relative tin content is about 25:1.

23. The process as defined by claim 18 wherein the work piece is cold worked at a time period of within about 24 hours after the cooling thereof.

24. The process as defined by claim 18 wherein the work piece is cold worked at a time period of within about 8 hours after the cooling thereof.

25. Cold worked lead-calcium-tin alloys produced by the process defined by claim 1 having a stable ultimate tensile strength at room temperature of at least about 6,000 psi., a stable stress-to-rupture life at room temperature of at least 25 hours at a stress level of 3,000 psi., and a stable, fine grained, worked, non-recrystallized microstructure at room temperature.

26. Cold worked lead-calcium-tin alloys produced by the process defined by claim 5 having a stable ultimate tensile strength at room temperature of at least about 6,500 psi., a stable stress-to-rupture life at room temperature of at least 5 hours at a stress level of 4,000 psi., and a stable, fine grained, worked, non-recrystallized microstructure at room temperature.

27. Cold worked lead-calcium-tin alloys produced by the process defined by claim 7 having a stable ultimate tensile strength at room temperature of at least about 8,500 psi., a stable stress-to-rupture life at room temperature of at least 30 hours at a stress level of 4,000 psi., and a stable, fine grained, worked, non-recrystallized microstructure at room temperature.

28. Cold worked lead-calcium-tin alloys produced by the process defined by claim 8 having a stable ultimate tensile strength at room temperature of at least about 9,000 psi., a stable stress-to-rupture life at room temperature of at least 100 hours at a stress level of 4,000 psi., and a stable, fine grained, worked non-recrystallized microstructure at room temperature.

29. Cold worked lead-calcium-tin alloys produced by the process defined by claim 9 having a stable ultimate tensile strength at room temperature of at least about 10,000 psi., a stable stress-to-rupture life at room temperature of at least 300 hours at a stress level of 4,000 psi., and a stable, fine grained, worked, non-recrystallized microstructure at room temperature.

30. Cold worked lead-calcium-tin alloys produced by the process defined by claim 13 having strength stability and microstructural stability at room temperature.

31. Cold worked lead-calcium-tin alloys produced by the process defined by claim 14 having a stable ultimate tensile strength at room temperature of at least about 6,000 psi., a stable stress-to-rupture life at room temperature of at least 25 hours at a stress level of 3,000 psi., and a stable, fine grained, worked, non-recrystallized microstructure at room temperature.

32. Cold worked lead-calcium-tin alloys produced by the process defined by claim 18 having a stable ultimate tensile strength at room temperature of at least about 6,500 psi., a stable stress-to-rupture life at room temperature of at least 5 hours at a stress level of 4,000 psi., and a stable, fine grained, worked, non-recrystallized microstructure at room temperature.

33. Cold worked lead-calcium-tin alloys produced by the process defined by claim 20 having a stable ultimate tensile strength at room temperature of at least about 8,500 psi., a stable stress-to-rupture life at room temperature of at least 30 hours at a stress level of 4,000 psi., and a stable, fine grained, worked, non-recrystallized microstructure at room temperature.

34. Cold worked lead-calcium-tin alloys produced by the process defined by claim 21 having a stable ultimate tensile strength at room temperature of at least about 9,000 psi., a stable stress-to-rupture life at room temperature of at least 100 hours at a stress level of 4,000 psi., and a stable, fine grained, worked, non-recrystallized microstructure at room temperature.

35. Cold worked lead-calcium-tin alloys produced by the process defined by claim 22 having a stable ultimate tensile strength at room temperature of at least about 10,000 psi., a stable stress-to-rupture life at room temperature of at least 300 hours at a stress level of 4,000 psi., and a stable, fine grained, worked, non-recrystallized microstructure at room temperature.

* * * * *

UNITED STATES PATENT AND TRADEMARK OFFICE

CERTIFICATE OF CORRECTION

PATENT NO. : 3,953,244

DATED : April 27, 1976

INVENTOR(S) : RAYMOND D. PRENGAMAN

It is certified that error appears in the above-identified patent and that said Letters Patent are hereby corrected as shown below:

Col. 3, line 37, "effects" should read -- efforts --. Col. 4, line 33, "lead-tin" should read -- lead-calcium-tin --. Cols. 7 and 8, Table V, a line should be drawn separating the data of Examples 16 and 17; under the caption "360", "10200" should read -- 11200 --; under the caption "720", "1070" should read -- 10700 --. Col. 8, line 61, after "ultimate" insert -- tensile --. Col. 9, line 14, after "applications" delete the comma (,).

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*